United States Patent [19]

Vrijssen et al.

[11] 4,278,912

[45] Jul. 14, 1981

[54] ELECTRIC DISCHARGE TUBE HAVING A GLASS-SEALED ELECTRIC LEADTHROUGH AND METHOD OF MANUFACTURING SUCH AN ELECTRIC LEADTHROUGH

[75] Inventors: Gerardus A. H. M. Vrijssen; Johannes P. T. Franssen, both of Eindhoven, Netherlands

[73] Assignee: U.S. Philips Corporation, New York, N.Y.

[21] Appl. No.: 50,005

[22] Filed: Jun. 18, 1979

[30] Foreign Application Priority Data

Jun. 24, 1978 [NL] Netherlands ..... 7806822

[51] Int. Cl.[3] ..... H01J 5/50

[52] U.S. Cl. ..... 313/331; 174/50.57; 174/50.61; 174/152 GM; 313/332; 313/477 HC

[58] Field of Search ..... 313/331, 332, 365, 364, 313/446, 477 HC; 174/50.57, 50.58, 50.61, 152 GM

[56] References Cited

U.S. PATENT DOCUMENTS

| | | | |
|---|---|---|---|
| 2,219,107 | 10/1940 | Langmuir | 250/27.5 |
| 3,113,878 | 12/1963 | Martin | 106/54 |
| 3,225,132 | 12/1965 | Baas et al. | 174/50.61 X |
| 3,370,874 | 2/1968 | Scherer et al. | 174/50.61 X |
| 3,379,822 | 4/1968 | Haans et al. | 174/50.57 |
| 3,675,062 | 7/1972 | Flasche | 313/365 |
| 3,712,997 | 1/1973 | Fisher | 174/50.58 |
| 3,854,069 | 12/1974 | Tagawa | 313/331 |
| 3,865,970 | 2/1975 | Vrijssen | 313/331 |
| 3,912,851 | 10/1975 | Vrijssen et al. | 174/50.61 |
| 4,155,614 | 5/1979 | Hall | 313/331 |

*Primary Examiner*—Saxfield Chatmon, Jr.
*Attorney, Agent, or Firm*—Marc D. Schechter

[57] ABSTRACT

An electric discharge tube is provided with a hermetically sealed leadthrough which electrically connects electrodes on the inner and outer walls of the envelope. The leadthrough consists of an aperture in the envelope having a conductive layer provided on the wall of the aperture. The aperture is hermetically sealed by means of a plug of thermally devitrified glass which is provided in the form of a suspension of a devitrified glass powder in an organic binder. To manufacture the leadthrough, the envelope of the tube is subjected to temperature treatments in which at a first temperature range the binder is fired from the suspension in an oxygen-containing atmosphere, and at a second temperature range the devitrifiable glass is devitrified in a non-oxidizing atmosphere. A hermetically sealed leadthrough results, without excessive oxidation of the electrodes, while the deformation of the glass envelope at the area of the leadthrough is avoided.

4 Claims, 3 Drawing Figures

ELECTRIC DISCHARGE TUBE HAVING A GLASS-SEALED ELECTRIC LEADTHROUGH AND METHOD OF MANUFACTURING SUCH AN ELECTRIC LEADTHROUGH

BACKGROUND OF THE INVENTION

The invention relates to an electric discharge tube comprising a glass envelope having at least one leadthrough which electrically connects a first electrically conductive layer provided on the inner wall of the envelope to a second electrically conductive layer provided on the outer wall of the envelope, said leadthrough consisting of an aperture which is provided in the envelope, the wall of which is coated with a third electrically conductive layer. The aperture is sealed hermetically by means of a glass plug.

The invention furthermore relates to a method of manufacturing such an electric leadthrough.

An electric discharge tube of the kind described above is disclosed in U.S. Pat. No. 2,219,107. In this patent the aperture for the leadthrough is obtained by perforating the glass envelope of the tube by means of a heated tungsten wire. In such a method, deformation of the glass envelope at the area of the aperture cannot be avoided. After having covered the wall of the aperture and the adjoining inner wall of the glass envelope with a metal layer, the aperture is sealed hermetically by means of a glass plug. This is done by heating the end of a glass rod to above its softening temperature and pressing the end in the aperture of the leadthrough. At the same time the glass envelope itself heated to near its softening temperature. As a result, again, deformation of the glass of the envelope in the proximity of the leadthrough can hardly be avoided.

Such a method is hence unfit for the manufacture of an electric leadthrough in the face plate of a camera tube because high optical quality is required of the face plate of such a tube. Deformations in the glass envelope are also undesirable in cathode ray tubes having a glass envelope of a small inside diameter, because such deformations may cause a local disturbance of the electric field distribution in the tube and may hence exert an undesired influence on the paths of the electrons in the tube. Furthermore, the known method is rather cumbersome and labor-intensive so that it is hardly suitable for use in mass production processes.

SUMMARY OF THE INVENTION

It is an object of the invention to provide an electric leadthrough in the envelope of an electric discharge tube in which the optical quality and the shape of the envelope in the proximity of the leadthrough are maintained. It is a further object of the invention to provide a method of manufacturing such a leadthrough.

According to the invention, an electric discharge tube of the kind described above is characterized in that the glass plug, by means of which the leadthrough aperture in the envelope is sealed hermetically, consists of a thermally divitrified glass.

A thermally devitrifiable glass is a glass which upon heating to a given temperature, which depends on the composition of the glass, changes into a crystalline phase. A characteristic of this type of glass is that the crystallized glass has a considerably higher softening or deformation temperature than the non-crystallized glass. This makes the use of this type of glass particularly well suited for sealing purposes in electron tubes because the starting glass can be processed at a comparatively low temperature and after crystallization the manufactured product can withstand higher temperatures without the glass becoming deformed. This latter feature is of particular importance with respect to the admissible temperature for the degassing of an electron tube. The present invention advantageously uses this property of a thermally divitrifiable glass.

According to a further aspect of the invention, the leadthrough aperture in the tube envelope can be filled with sealing glass in the form of a suspension of glass powder in an organic powder. As a result, the glass envelope of the tube cannot deform either upon providing the glass suspension or upon heating to the crystallization temperature of the sealing glass. Of course, the glass of the envelope should have a higher softening temperature than the crystallization temperature of the sealing glass.

The wall coating referred to as the first conductive layer may serve as an electrode and is preferably provided simultaneously with at least the conductive layer to be provided on the wall of the leadthrough so that these layers form one assembly of one and the same material.

The cross-section tranverse to the axis of the aperture provided in the tube envelope preferably decreases inwardly. This facilitates not only the provision of the glass suspension in the aperture, but also results in a very small insulating surface on the inner wall of the envelope. The possibility that the electric field distribution in the tube will be disturbed as a result of electric charging of the insulating surface is thus minimized.

It is to be noted that a glass to metal bond is disclosed in U.S. Pat. No. 3,113,878 in which a tungsten or molybdenum wire is passed through an aperture provided in a glass plate and the aperture is sealed by means of a thermally devitrified glass. The construction described in that patent, however, not suitable as an electric leadthrough for a conductive layer which is provided on the inner wall of the envelope of an electron tube because a reliable electric contact between the wire and the electrode is difficult to realize. In addition, the part of the wire projecting inwardly in the tube causes a local disturbance of the electric field distribution.

It is also stated in U.S. Pat. No. 3,113,878 that the sealing process is carried out in a non-oxidizing atmosphere if metals are used which are sensitive to oxidation. Preventing oxidation of the electrodes provided on the inner wall of the envelope also is a large problem in manufacturing an electric leadthrough according to the present invention because, inter alia, oxidized electrodes cannot be electrically connected to other parts of the tube. In fact, when using a glass suspension with an organic binder it has been found that while the performance of the sealing process, that is to say the maintaining of the temperature at the crystallization temperature of the sealing glass, under a non-oxidizing atmosphere prevents the oxidation of the electrodes, it also results in a non-hermetically sealed leadthrough. Although this cannot be said with absolute certainty, the cause of this problem is presumably due to the fact that the organic binder of the glass suspension cannot be burnt or fired in a non-oxidizing atmosphere.

A solution to this problem has been found in a method of manufacturing an electric leadthrough in the glass envelope of an electric discharge tube, according to the present invention, in which the aperture of the leadthrough in the tube envelope is filled with a suspension consisting substantially of a thermally devitrifiable glass in powder form and an organic binder, after which the envelope is subjected to heat treatments within two temperature ranges. At the first temperature range, the organic binder is fired from the suspension while an oxygen-containing atmosphere is present at least on the outside of the envelope. At the second temperature range, the temperature is above to the crystallization temperature of the devitrifiable glass so as to transform the glass at least partly into a crystalline phase while a non-oxidizing atmosphere is present at least on the inside of the envelope. Since, at the first temperature range an oxygen-containing atmosphere is present at least on the outside of the envelope, the outside of the electric leadthrough is also in contact with the oxygen-containing atmosphere. This contact must be sufficient to fire, from the outside, the organic binder over a sufficient depth of penetration. Since at the second temperature range a non-oxidizing atmosphere is present on the inside of the envelope, the electrodes on the inner wall of the envelope will not be oxidized. The result of the method described is that on the one hand no annoying oxidation of the electrodes occurs while on the other hand a hermetically sealed electric leadthrough is obtained. According to another embodiment of the invention, at both the first and the second temperature ranges a non-oxidizing atmosphere is present on the inside of the envelope and an oxygen-containing atmosphere is present on the outside of the envelope.

According to another embodiment of the invention, at the first temperature range an oxygen containing atmosphere is present both on the inside and on the outside of the envelope while at the second temperature range a non-oxidizing atmosphere is present both on the inside and on the outside of the envelope. Although in this method the electrodes are in contact with with an oxygen-containing atmosphere during the first temperature treatment, the temperature at the first treatment should only be sufficiently high to fire the organic binder from the glass suspension. This temperature which lies between approximately 350° C. and 390° C. does not yet result in any annoying oxidation of the electrodes. In the second temperature treatment, a devitrification or crystallization of the sealing glass takes place. The temperature required for this purpose generally lies between approximately 420° C. and 450° C. In this temperature range it becomes necessary to protect the electrodes from oxidation. Since the organic binder has already been fired from the suspension, both the inside and the outside of the tube envelope may be surrounded by a non-oxidizing atmosphere during the second temperature treatment.

The invention will now be described in greater detail with reference to the drawing.

DESCRIPTION OF THE PREFERRED EMBODIMENTS

Figure 1:
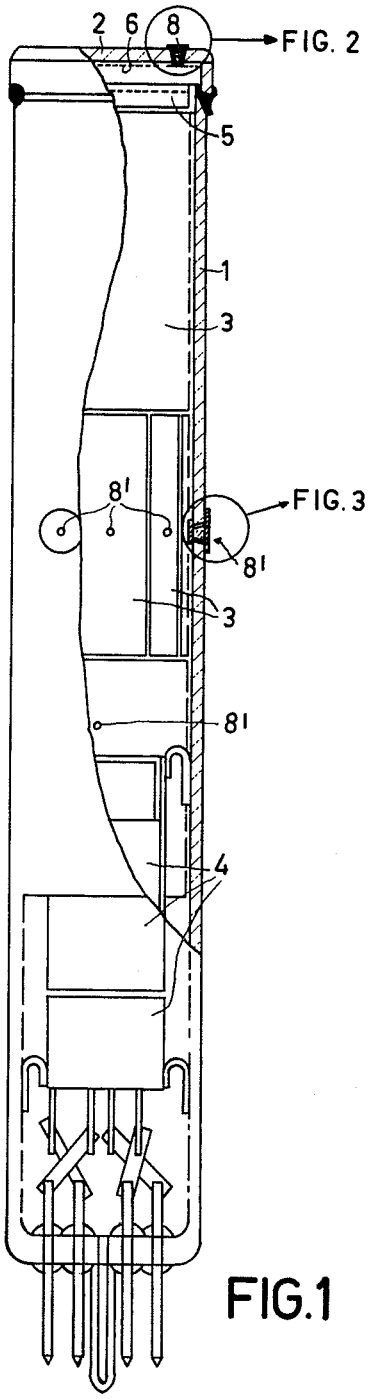
FIG. 1 shows diagrammatically a television camera tube having a number of electric leadthroughs according to the invention.

The tube shown in FIG. 1 comprises a glass envelope 1 which is sealed by means of a glass face plate 2. A number of thin-film electrodes 3 consisting of nickel are present on the inner wall of the envelope 1. These electrodes 3 serve to focus and electrostatically deflect an electron beam generated by an electron gun system 4 accummodated in the tube. The electron beam is directed on the face plate 2 and, after passing a guaze electrode 5 arranged in the tube, impinges on a photosensitive layer 6 provided on the face plate 2. A number of electric leadthroughs 8 and 8′ are provided in the envelope 1 and the face plate 2 to bring the electrodes 3 to the desired voltage and to derive the signal from the photosensitive layer 6.

Figure 2:
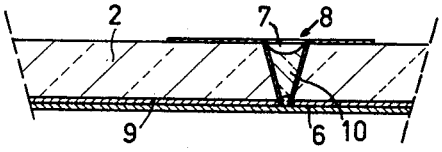
FIGS. 2 and 3 show embodiments of the electric leadthrough as used in the television camera shown in FIG. 1.

FIG. 2 shows in detail a leadthrough 8 provided in the face plate. An aperture 7, the cross-section of which, transverse to the axis of the aperture, decreases in the inward direction, is provided in the face plate 2 by means of sandblasting. The diameter of the aperture on the outside of the face plate is, for example, approximately 1 mm and on the inside approximately 0.5 mm.

The inner wall of the face plate 2 is covered with a thin layer of tin oxide ($SnO_2$) serving as a signal electrode 9. The tin oxide layer extends over the wall of the aperture 7 and over a part of the outer wall of the envelope 1 so that a good contact face on the outside of the envelope has been obtained. The aperture 7 is sealed hermetically by means of a plug of thermally devitrified glass 10.

Figure 3:
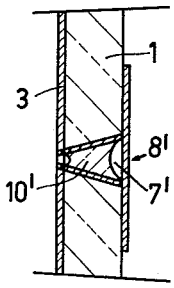

The leadthrough 8′ shown in detail in FIG. 3 consists of an aperture 7′ provided in the envelope 1. A layer of nickel on the inner wall of envelope 1 serves as an electrode 3 and also extends over the wall of the aperture 7′ and over a part of the outer wall of the envelope 1. The layer of nickel has been provided chemically on the wall of the envelope 1 by electroless nickel plating. The aperture 7′ is sealed hermetically by means of a plug of thermally devitrified glass 10′.

The method of manufacturing the leadthroughs 8 and 8′ is carried out as follows. After providing a conductive layer integrally or in parts on the inner wall of the envelope 1 or the face plate 2, the wall of the leadthrough aperture (7, 7′) and a part of the outer wall of the envelope 1 or the face plate 2, the aperture (7, 7′) is filled at least partly with a suspension of a powdered devitrifiable glass and an organic binder. A suitable glass for this purpose is, for example, a type of glass commercially available under the trade name Pyroceram which has the approximate composition of 70–80% by weight PbO, 6–12% by weight $B_2O_3$, 7–15% by weight ZnO, 1–3% by weight $SiO_2$ and 0–3,5% by weight $Al_2O_3$. A suitable organic binder is, for example, a solution of 1–3% nitrocellulose in amyl acetate.

The envelope 1 and the face plate 2 are then subjected in a furnace, to successive heat treatments in which the temperature in the furnace is increased to within a first temperature range, approximately 380° C., by approximately 3° C. per minute in the presence of an oxygen-containing atmosphere (e.g. air). After having maintained this temperature for approximately 5 minutes, the organic binder has sufficiently been fired from the glass suspension and the oxygen-containing atmosphere is replaced by a non-oxidizing atmosphere, for example nitrogen gas. The temperature is then raised to within a second temperature range, approximately 440° C., at the same rate and maintained at this temperature for approximately one hour. The crystallization of the devitrifiable glass takes place in this second temperature range. While maintaining the non-oxidizing atmosphere, the envelope and the face plate are finally cooled to room temperature at a rate of approximately 8° C. per minute. The leadthroughs obtained in this manner are hermetically sealed and the electrodes on the wall of the envelope do not show any undesired oxide skin. The tube may then be assembled in the usual manner, for example by providing the electron gun in the tube, by thermally sealing the tube to the face plate, and finally by degassing of the tube.

In the example described, the second heat treatment immediately succeeded the first heat treatment. It is not objectionable however, if for some reason or other it should be desired to cool the tube after the first heat treatment and to subject the tube to the second heat treatment at a later time. The method described is excellent for mass production because a number of tubes can simultaneously be provided with the desired leadthroughs.

What is claimed is:

1. An electric discharge tube comprising a glass envelope having an inner wall, an outer wall, and an electric leadthrough connecting these walls, said envelope having a first electrically conductive layer on the inner wall and a second electrically conductive layer on the outer wall, said leadthrough comprising a third electrically conductive layer, present on a wall of an aperture in the glass envelope and electrically connected to the first and second layers, and a glass plug hermetically sealing the aperture, said glass plug comprising hermetically sealing, thermally devitrified glass;

wherein the aperture has an axis which points in a direction from the outer to the inner wall, and the cross-section of the aperture, transverse to its axis, decreases in the inward direction.

2. A method of manufacturing a hermetically sealing electric leadthrough in a glass envelope of an electric discharge tube, said envelope having an inside wall and an outside wall, and thin film metal electrodes on both the inside and outside walls, said method comprising the sequential steps of:

forming an aperture in the glass envelope, said aperture having a wall extending between the inside and outside walls;

forming an electrically conductive layer on the wall of the aperture, said layer electrically connecting the electrodes on the inside and outside walls of the envelope to form a leadthrough;

filling the aperture with a suspension of a powdered, thermally devitrifiable glass in an organic binder, said devitrifiable glass having a crystallization temperature below the softening temperature of the glass envelope;

heating the envelope to a temperature within a first temperature range, the outside of the envelope being in an oxygen atmosphere, said temperature range being sufficient to fire organic binder from the suspension; and heating the envelope to a temperature within a second temperature range, the inside of the envelope being in a non-oxidizing atmosphere, said temperature range being sufficient to at least partly crystallize the devitrifiable glass.

3. A method as claimed in claim 2, wherein during both heating steps a non-oxidizing atmosphere is present on the inside of the envelope and an oxygen atmosphere is present on the outside of the envelope.

4. A method as claimed in claim 2, wherein during the heating step to a temperature within the first temperature range an oxygen atmosphere is present both on the inside and on the outside of the envelope, while during the heating step to a temperature within the second temperature range a non-oxidizing atmosphere is present both on the inside and on the outside of the envelope.

* * * * *